United States Patent [19]

Rod

[11] 4,223,317

[45] Sep. 16, 1980

[54] DUAL POLARIZATION ANTENNA COUPLETS

[75] Inventor: Robert L. Rod, Marina Del Rey, Calif.

[73] Assignee: Monogram Industries, Inc, Santa Monica, Calif.

[21] Appl. No.: 864,934

[22] Filed: Dec. 27, 1977

[51] Int. Cl.[2] ..... H01Q 19/26; H01Q 9/38

[52] U.S. Cl. ..... 343/803; 343/819; 343/846

[58] Field of Search ..... 343/725, 726, 727, 728, 343/729, 730, 846, 803, 819

[56] References Cited

U.S. PATENT DOCUMENTS

| | | | |
|---|---|---|---|
| 2,425,585 | 8/1947 | Wheeler | 343/830 |
| 3,404,404 | 10/1968 | Theakston | 343/727 |
| 3,671,973 | 6/1972 | French | 343/797 |
| 3,771,162 | 11/1973 | Dienes | 343/797 |
| 3,821,742 | 6/1974 | Pollard | 343/727 |
| 3,922,684 | 11/1975 | Wright | 343/873 |

OTHER PUBLICATIONS

Utica Communications Corp., Advertisement, 1 page, 1965.

*Primary Examiner*—Eli Lieberman

*Attorney, Agent, or Firm*—Freilich, Hornbaker, Wasserman, Rosen & Fernandez

[57] ABSTRACT

A dual polarized antenna couplet, comprised of a vertical quarter-wavelength radiator driven at its lower end and centered on a half-wavelength horizontal dipole radiator drooping its ends about 45° from the center where it is driven in phase with the vertical radiator, produces a polarized wavefront at an angle between the vertical and the horizontal, such as 45° when both are driven equally, with 1.5 db bi-directional gain in the horizontal pattern and in the vertical pattern as well. A similar parasitic couplet is used as a reflector behind the driven couplet, and two or more parasitic couplets are used as directors in front of the driven couplet. The elements of the antenna are coated with dielectric material to achieve a shortening effect of about 11% over the normal lengths of the antenna elements otherwise required.

3 Claims, 6 Drawing Figures

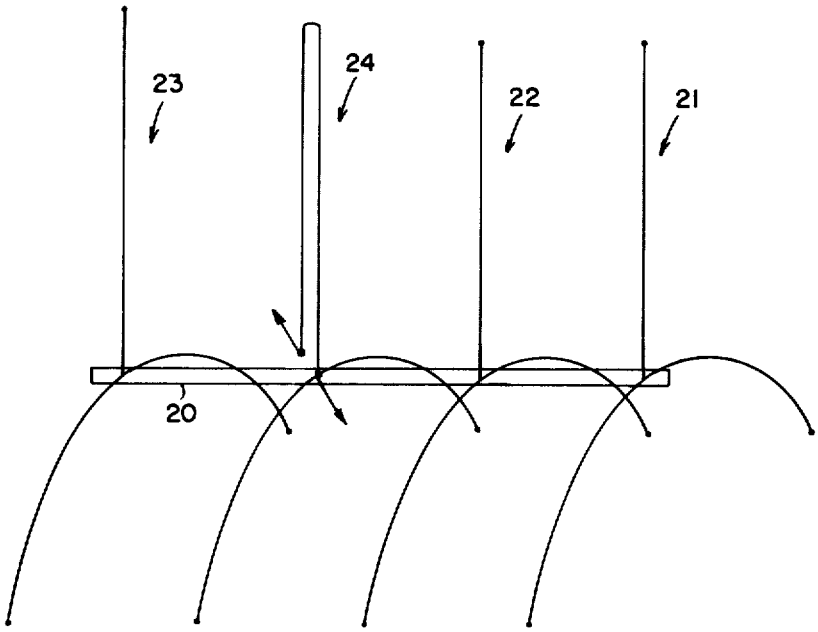
FIG. 6
FIG. 2
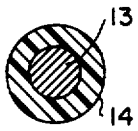

DUAL POLARIZATION ANTENNA COUPLETS

BACKGROUND OF THE INVENTION

This invention relates to an improved antenna structure, and method of transmission and/or reception through such an antenna, and more particularly to a dual polarized antenna for such use as citizens band (CB) radio communication.

The need for a dual polarized CB antenna has been widely recognized. See for example U.S. Pat. Nos. 2,982,959 and 3,821,742. This need arises from the fact that although virtually all mobile CB antennas are vertically polarized, as are the base stations, experience has shown that much signal reception is by way of reflections from buildings and reradiations from power lines and the like. As a result, communications between vertical antennas has been erratic. The polarization of signals can be rotated by multiples of about 90° at any given location resulting in a "dead spot" at that location, and reduced signal at other locations where the rotation is less than 90°. It would be desireable to transmit radiation polarized at an angle between the vertical and the horizontal, for example 45°.

It has been found that such a 45° polarization is achieved when both vertical and horizontal radiators are fed equal energy in an antenna couplet comprised of a quarter wave vertical radiator with its lower end positioned in the center of a horizontal dipole radiator. There is then achieved a bi-directional gain of 1.5 db in the horizontal pattern and some gain in the vertical pattern as well, depending upon the height of the antenna couplet above ground. This makes an antenna couplet very useful in radio communications where it is desirable for radiation to take place simultaneously in both the vertical and horizontal polarization modes, especially if the same type of antenna couplet is used to receive the radiation at the opposite end of the communication path in which case the gains just mentioned are doubled.

OBJECTS AND SUMMARY OF THE INVENTION

An object of this invention is to provide an improved antenna.

Another object is to provide an improved directive antenna employing a plurality of my antenna couplets.

These and other objects of the invention are achieved by an antenna couplet comprised of a vertical radiator with its lower end positioned in the center of drooping horizontal dipole radiator, where each radiator is preferably, but not necessarily, an electrically conductive element formed of a wire serving as the conductor coated with a material having a dielectric constant greater than air. The diameter of the wire and the weight of the dielectric sheath are selected to produce a droop at the ends of the horizontal dipole radiator equal to about 30° to 45° with respect to the horizontal. The length of each half of the dipole, and the length of the vertical radiator, may be physically less than one quarter wavelength in free space by about 11% due to the dielectric coating. The vertical and horizontal radiators are driven equally and in phase. The vertical element may be a folded dipole a quarter wavelength long using the adjacent horizontal element as its ground plane. Additional parasitic antenna couplets may be mounted on a horizontal boom, at least one on one side of the driven couplet to act as a reflector and at least one on the other side to act as an antenna beam director.

The novel features that are considered characteristic of this invention are set forth with particularity in the appended claims. The invention will best be understood from the following description when read in connection with the accompanying drawings.

BRIEF DESCRIPTION OF THE DRAWINGS

FIG. 2 is a cross section illustrating the preferred "pultrusion" construction of each antenna element of the couplet of FIG. 1.

FIG. 6 illustrates the antenna couplet of FIG. 3 with parasitic antenna couplets in a directive antenna array.

DESCRIPTION OF PREFERRED EMBODIMENTS

Figure 1:
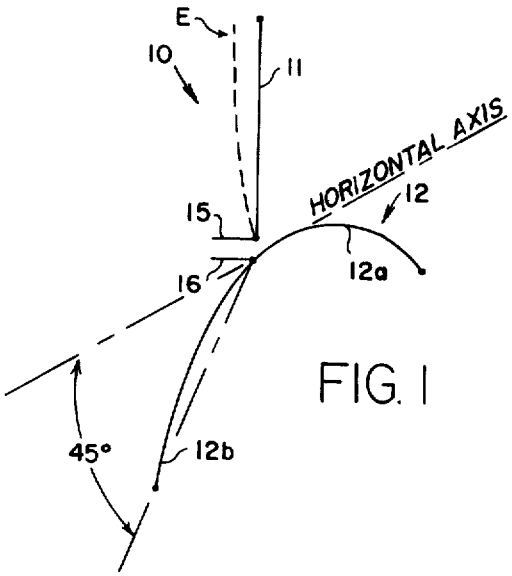
FIG. 1 illustrates an antenna couplet on which the present invention is based.

Referring now to the drawings, FIG. 1 illustrates a dual polarization antenna couplet 10 comprised of a quarter-wavelength vertical element 11 and a half-wavelength horizontal dipole element 12. Each element preferably is formed as a "pultrusion" comprised of a conductive wire encased or embedded in a dielectric sheath, although uninsulated elements also could be used. The sheath is formed from fiber glass thread that is drawn from spools and dipped in polyester resin, and then pulled through a heated die in a circle around conductive wire, such as copper wire, introduced at the die. The pultrusion is thus thermoset and then cut to appropriate lengths. The pultrusion for the horizontal element are made to have a ¼" diameter for greater flexibility than the vertical element, which is made to have a 5/16" diameter by using a die of larger diameter. The more flexible horizontal element thus droops at the ends about 30° to 45° with respect to the horizontal. FIG. 2 shows a cross section of a pultruded antenna element consisting of a conductive wire 13 and a sheath or coating of dielectric material 14 such as glass fiber reinforced polyester resin.

This technique of producing pultrusions for the purpose of coating rods with a protective sheath has come into widespread use, but in this application, the purpose for its use goes significantly beyond merely providing protection of the conductive wire against corrosion. It has been found that by coating a conductor with a material having a dielectric constant greater than air, such as glass reinforced polyester, a shortening effect of about 11% is observed in the length of the element as compared to a bare element of identical diameter. Consequently, a pultruded wire shortens all elements made from the wire by 11% and, in the case of an antenna designed for CB communications, reduces the total dimensions for shipping such that express company restrictions on packages not exceeding 108 inches in length plus girth can be easily met. Had one piece aluminum tubing been used to construct the antenna shown in FIG. 1 for CB operation at 27 MHz, the longest element would have been about 111 inches long, too long for rapid delivery. An 11% reduction in length achieved by making the element from a pultrusion reduces the length to 97 inches, leaving 11 inches for the girth of the package. To meet the "108 inch" rule with aluminum tubing, it is necessary to make elements by telescoping aluminum tubing. A telescoping antenna is more costly to produce and less reliable in performance.

An even more important advantage of using light weight pultruded elements is the ability to permit the horizontal elements to droop at the ends by as much as 50° below horizontal without permanent damage encountered with aluminum tubing. The drooped element is useful in varying the relationship between energy transmitted or received in the two polarizations. Drooping the elements by 45°, for example, divides the radiation of the dipole equally between horizontal and vertical elements, as may be desired in practice. This droop is illustrated in FIG. 1. The quarter-wave length element (at the desired operating frequency) is mounted vertically at the center, or close to the center, of the half-wave length horizontal dipole. When the couplet elements are electrically joined together at the center of the dipole, the structure will act as a parasitic element when near a driven antenna couplet constructed as illustrated in FIG. 1. Connections are made to drive the couplet elements through leads 15 and 16. Although reference is made throughout to driving the elements, it is understood that an antenna receiving operation is the reciprocal of the transmitting operation. While receiving, the antenna leads 15 and 16 are connected to a receiver. Consequently the same leads are used to transmit and receive. Switching the leads between a transmitter output and a receiver input is accomplished within the transmitter-receiver unit whenever the same unit is used for both purposes, as is commonly the case in CB communications.

Figure 3:
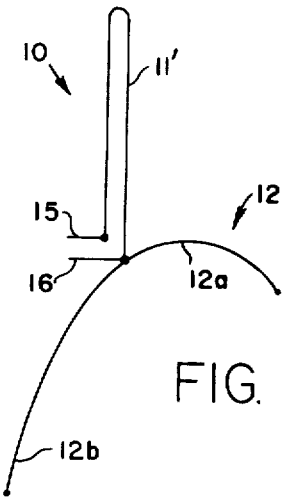
FIG. 3 illustrates an improved antenna couplet with a folded vertical dipole serving as the driven element.

Referring now to FIG. 3, it shows an antenna couplet similar to that in FIG. 1 except that the vertical element 11' is formed as a quarter-wavelength folded dipole.

This folded dipole overcomes one of the persistent problems in antenna design, which is that of matching an antenna to a transmission line, the latter typically of 50 ohm impedance, particularly in CB communications. The conventional Yagi-Uda array using a half-wave dipole driven element displays an impedance at resonance in the order of 20–30 ohms. The dipole itself in free space has an impedance of 72 ohms which is drastically lowered by the near proximity of the parasitics. This creates a mismatch that unless overcome yields excessively high standing wave ratios. To overcome this problem in the conventional Yogi-Uda array, extensive use is made of different matching schemes known as the Gamma match, the Delta match, the "hairpin" and others. Substituting the folded dipole 11' for the straight quarter-wave length vertical element 11 produces a 50 ohm impedance at transmission line terminals with absolutely no requirement for any type of matching device. The free space impedance of a quarter wave vertical folded dipole is 150 ohms. This is lowered to 50 ohms by judicious placement of the neighboring parasitic couplets as shown in FIG. 6.

Figure 4:
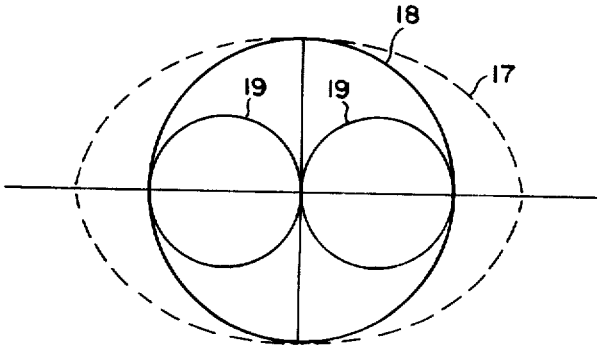
FIG. 4 illustrates in a plan view the resultant antenna beam pattern gain achieved with an antenna couplet of the present invention.

Before describing FIG. 6 in more detail, the radiation patterns resulting from antenna couplets shown in FIGS. 1 and 3 will be described with reference to FIGS. 4 and 5. Assuming radio energy at the resonant frequency of the couplet is applied to the transmission line (leads 15 and 16), a horizontal radiation pattern of the antenna couplet is produced as shown in FIG. 4 by a dashed line 17. It is the resultant between two antenna patterns shown in solid lines, one a circular pattern 18 centered on the vertical element 11 and the other a figure-8 pattern 19 with each lobe on either side of the horizontal dipole element 12.

As is well known in the art, a quarter wavelength antenna operates against a counterpoise "image" formed by the reflective earth, or by an artificial ground comprised of a circular array of radial elements that usually are one quarter wavelength long at or near the resonant frequency of the antenna system. Such artificial grounds are called "ground planes" and invariably consist of at least three and usually four spokes spaced 120° or 90° apart in these typical cases. Under such conditions with radials extending in all directions, the horizontal pattern of a so-called "quarter-wavelength ground-plane antenna" is circular or omnidirectional, and the vertical pattern is one half of the well known figure-8 pattern of a vertical dipole.

In the antenna couplet of FIGS. 1 and 3, only two quarter-wavelength elements form the ground plane, and these are both opposite to each other and perpendicular to the direction of maximum horizontal radiation. As a consequence, a bi-directional gain effect is achieved that is not seen in a conventional ground-plane vertical antennas having equally spaced radial elements. Specifically, in FIG. 4, circle 18 shows the horizontal radiation pattern of the vertical element 11 when looking down on the antenna from above. This radiation is vertically polarized. The figure-8 pattern 19 illustrates the horizontal radiation pattern of the dipole 12 comprised of quarter-wave elements **12*a* and 12*b*. This radiation is horizontally polarized. Assuming that elements 11, 12*a* and 12*b* all are identical in length, and are one quarter wavelength long at the operating frequency, there will be maximum voltage E at the top of the vertical element 11 at the same time the voltages E at the ends of elements 12*a* and 12*b* also will be maximum as shown in FIG. 1. In fact, element 11 plus elements 12*a* and 12*b* comprise a pair of dipoles bent 90° in the middle which operate simultaneously with the dipole comprised of elements 12*a* and 12*b* alone. All these elements are driven in phase and thus the radiation for this case in both polarizations, horizontal and vertical, are equal. Consequently, the resultant pattern 17 is tilted 45° with respect to elements 11 and 12*a* (or 11 and 12*b***). The maximum magnitude of the resultant at 45° is the square root of 2, or 1.414. This is equivalent to a gain of 1.5 db.

Figure 5:
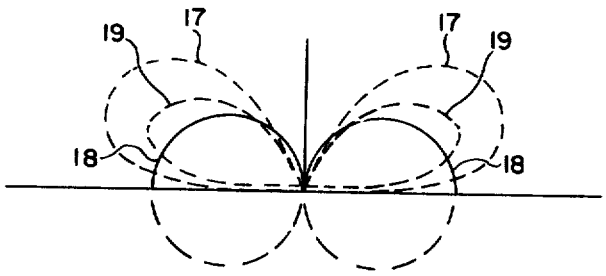
FIG. 5 illustrates an elevation view of the resultant antenna beam pattern of FIG. 4.

Similarly, for the vertical radiation patterns, FIG. 5 depicts the typical figure-8 pattern 18 of a quarter wavelength vertical antenna above ground, which in this case is taken to be the plane of the two ground plane elements **12*a* and 12*b*. The figure-8 pattern is shown by full-line half circles in the real portions above ground and by dotted lines for the images. The dipole comprised of quarter wave length elements 12*a* and 12*b* illustrated looking into their axes has the classic dipole radiation pattern 19 governed by height above the real earth ground in this case. Illustrated is an example of the one vertical lobe system that is seen when the horizontal dipole is mounted one-half wave length above the true ground. Adding patterns 18 and 19 together, keeping in mind that pattern 18 is vertically polarized and pattern 19 is horizontally polarized, produces a resultant pattern 17** polarized at 45° with respect to the parts of the couplet.

The combination of horizontal and vertical radiation components as opposed to the existance of circular or elliptical polarization found in some antennas has practical use in communications. As an illustration, consider CB communications at a frequency of about 27 Mhz wherein most radio contacts are by way of vertically polarized ground waves having an effective range of a few kilometers at the legal power limit of 4 watts. Virtually all CB mobile antennas are vertically polarized as are the base station antennas used universally before the present invention. Experience has shown that much signal reception is by way of reflections off buildings and by reradiation from power lines and the like. As a result, communications between stations using vertical antennas exclusively has been erratic. Signals can and do arrive shifted at or near 90° or multiples thereof in polarization resulting in numerous dead spots. On the other hand, tests with an antenna couplet made in accordance with this invention have demonstrated the desireability for transmission and reception in both polarizations. No dead spots ever have been encountered between a station using an antenna couplet and all other types of vertical antennas. Similarly, tests between two stations both using antenna couplets have shown remarkable increases in signal strengths beyond that achievable with other types of antennas.

The preferred embodiment for an antenna using an antenna couplet is comprised of two or more antenna couplets. FIG. 6 illustrates one configuration displaying about twice the gain of an equivalent antenna of more conventional nature and of similar boom length. Shown is a boom 20 of aluminum tubing coated with insulation material, typically a pultrusion of glass-reinforced polyester on which are mounted three couplets, 21, 22 and 23, of the nature shown in FIG. 1. They are parasitically driven by a folded dipole couplet 24 illustrated of the nature shown in FIG. 3. At first glance, the vertical quarter wavelength elements appear to be arranged in the well-known Yagi-Uda configuration wherein the spacing between the driven couplet 24 and the parasitic couplet 23 acting as a reflector is greater than the spacings between couplets 21 and 22 acting as directors, or between the driven couplet 24 and the nearest director couplet 22. Also, the vertical element of the reflector couplet 23 is from 2.5 to 7% (typically 4.5%) longer than the driven element. Moreover this array of vertical elements is only half as high as the elements of a conventional Yagi-Uda antenna mounted vertically. That is because the conventional Yagi-Uda is one half wavelength long; here it is half that. There is also no connection electrically between couplets along the boom which could destroy their performance by acting as radial(s) in the preferred direction of radiation as has been used in the prior art in a vertical log-periodic antenna having two ground plane radials perpendicular to the direction of radiation for each vertical element. The common transmission line driving all successive vertical elements alternately in 180° phase shifts in that prior art antenna act as unwanted radials, and prevent it from displaying the dual polarization and added gain of the present invention. In point of fact, the prior art known shows no other half-height vertical Yagi-Uda configuration having this performance.

Added to these advantages of the present invention in beam formation and dual polarization are several important mechanical features shown in FIG. 6: the height of the antenna is half that of a vertical dipole; rotating the boom 20 for aiming purposes can be accomplished by placing the rotor directly under the boom without interfering with the radiation pattern as is the case when a conventional vertical Yagi-Uda antenna is mounted on a pole protruding up between elements and interfering with the radiation pattern; and as noted hereinbefore, the use of pultruded elements has advantages for a number of reasons other than that there is no exposed metal to corrode in use. By coating a conductor with glass reinforced polyester materials having a dielectric constant exceeding that of air, a shortening effect of about 11% is observed in the length of an element as compared to a bare element of identical size. Accordingly, this feature shortens all elements by 11% and, in the case of an antenna designed for CB work, reduces the dimensions such that they meet the "108 inch rule" of both the Post Office and United Parcel Service.

Although particular embodiments of the invention have been described and illustrated herein, it is recognized that modifications and variations may readily occur to those skilled in the art. It is therefore intended that the claims be interpreted to cover such modifications and variations.

What is claimed is:

1. An antenna couplet comprised of a vertical radiator with its lower end positioned in the center of a dipole radiator, where each radiator is an electrically conductive element and the dipole radiator droops from the center to the ends in a continuous curve, wherein the dipole radiator droop at each end is equal to about 45° as measured between a horizontal axis and a line between the center of the dipole radiator and the end thereof, wherein the vertical radiator and dipole radiator are driven equally and in phase for radiation of a wavefront polarized at an angle of about 45° from the vertical, and wherein the vertical radiator is a folded dipole a quarter wavelength long.

2. The combination of claim 1 including additional parasitic antenna couplets mounted on a horizontal boom, at least one on one side of the driven couplet functioning as a reflector and at least one on the other side of the driven couplet functioning as an antenna beam director.

3. The combination of claim 2 wherein the vertical element of the reflector couplet is longer than the element of the director couplet, and the director couplet is shorter than the vertical element of the driven couplet.

* * * * *